US010975665B2

(12) United States Patent
Zhao et al.

(10) Patent No.: US 10,975,665 B2
(45) Date of Patent: Apr. 13, 2021

(54) METHODS AND APPARATUS FOR DEPOSIT CONTROL

(71) Applicants: Lei Zhao, Houston, TX (US); Zhiyue Xu, Cypress, TX (US); Zhi Yong He, Cypress, TX (US); Yuh Loh, Cypress, TX (US)

(72) Inventors: Lei Zhao, Houston, TX (US); Zhiyue Xu, Cypress, TX (US); Zhi Yong He, Cypress, TX (US); Yuh Loh, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 3 days.

(21) Appl. No.: 15/806,365

(22) Filed: Nov. 8, 2017

(65) Prior Publication Data

US 2019/0136667 A1 May 9, 2019

(51) Int. Cl.
*E21B 37/06* (2006.01)

(52) U.S. Cl.
CPC ..... *E21B 37/06* (2013.01)

(58) Field of Classification Search
CPC ..... E21B 37/06
See application file for complete search history.

(56) References Cited

U.S. PATENT DOCUMENTS 2,872,982 A * 2/1959 Wade ..... C09K 8/845 166/300
4,440,229 A * 4/1984 Burch ..... E21B 17/1078 166/311
2005/0161372 A1* 7/2005 Colic ..... B01D 17/047 208/391
2006/0084580 A1* 4/2006 Santra ..... C09K 8/516 507/239
2010/0139924 A1* 6/2010 Abney ..... E21B 36/005 166/335
2013/0068462 A1* 3/2013 Pantano ..... E21B 43/25 166/305.1
2015/0068749 A1* 3/2015 Wernimont ..... E21B 43/243 166/300
2016/0186548 A1* 6/2016 Pantano ..... E21B 43/25 166/250.01
2018/0265682 A1* 9/2018 Roy ..... E21B 33/1208

OTHER PUBLICATIONS

Brimmer et al. "Deepwater Chemical Injection Systems: The Balance between Conservatism and Flexibility", OTC18308 (2006) 14 pages.
He, et al. "Development and Qualification of a High-Pressure, High-Temperature Chemical Injection Valve", OTC-25159-MS (2014) 8 pages.
Olsen, John Helge "Statoil Experiences and Consequences related to Continuous Chemical Injection", SPE 146625 (2011) 10 pages.

* cited by examiner

*Primary Examiner* — Crystal J Miller
(74) *Attorney, Agent, or Firm* — Cantor Colburn LLP

(57) ABSTRACT

A method of controlling deposit buildup comprises generating a gas by reacting an active material in a gas generating element with a fluid that contacts the gas generating element; and controlling deposit buildup with the generated gas.

16 Claims, 2 Drawing Sheets

METHODS AND APPARATUS FOR DEPOSIT CONTROL

BACKGROUND

Many articles used in the oil and gas industry are exposed to harsh environments. For example, tools used in a wellbore or other downhole environment are often exposed to corrosive fluids, which may cause deposits of inorganic or organic compounds such as $CaCO_3$, $BaSO_4$, $CaSO_4$, $SrSO_4$, hydrates, asphaltenes, and wax to build up on the surfaces of the articles. These compounds often precipitate upon pressure, temperature, and compositional changes resulting from blending or other mechanical or physicochemical processing. Such precipitation occurs in pipelines, valves, separators, pumps, and other equipment. Once precipitated, deposits can interfere with the normal function of the articles, block fluid flow, and decrease well production rates. The deposits may also necessitate repairs or replacements.

Various chemicals, such as scale inhibitors, wax inhibitors, and hydrate inhibitors have been used to prevent the formation of deposits from blocking or hindering fluid flow. Acids, chelates, and the like have also been used to break or dissolve certain deposits that are already formed.

Other techniques include forming a hydrophobic coating on critical areas of downhole tools. Exploration and production companies have also used remediation tools, such as abrasive jets and mechanical tools, to remove the deposits.

However, many existing techniques require costly well intervention, add up to non-productive time, or are sometimes not feasible or not effective for certain wells. Accordingly, an alternative method of controlling deposit accumulation is continuously sought.

BRIEF DESCRIPTION

A method of controlling deposit buildup comprises generating a gas by reacting an active material in a gas generating element with a fluid that contacts the gas generating element; and controlling deposit buildup with the generated gas.

A deposit control member comprises a gas generating element and a cover to protect the gas generating element, the gas generating element containing an active material which is effective to react with a fluid contacting the gas generating element to generate a gas.

A flow assembly configured to control deposit buildup when exposed to a fluid comprises a tubular member; and a deposit control member as described above coupled to the tubular member.

A flow assembly configured to control deposit buildup when exposed to a fluid comprises a tubular member defining a fluid pathway; and a gas generating element as described above disposed inside the tubular member.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
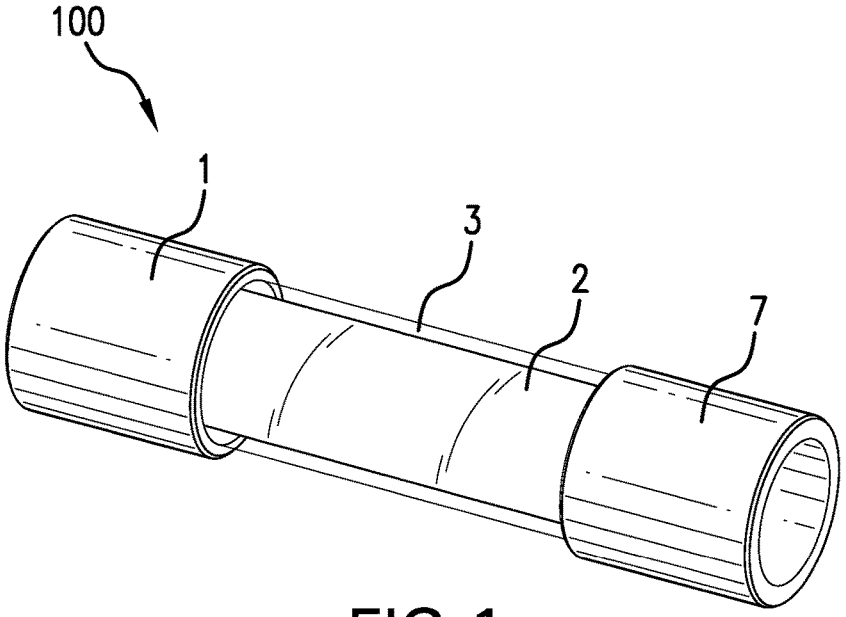
FIG. 1 is a side view of an exemplary deposit control member according to an embodiment of the disclosure.
Figure 2:
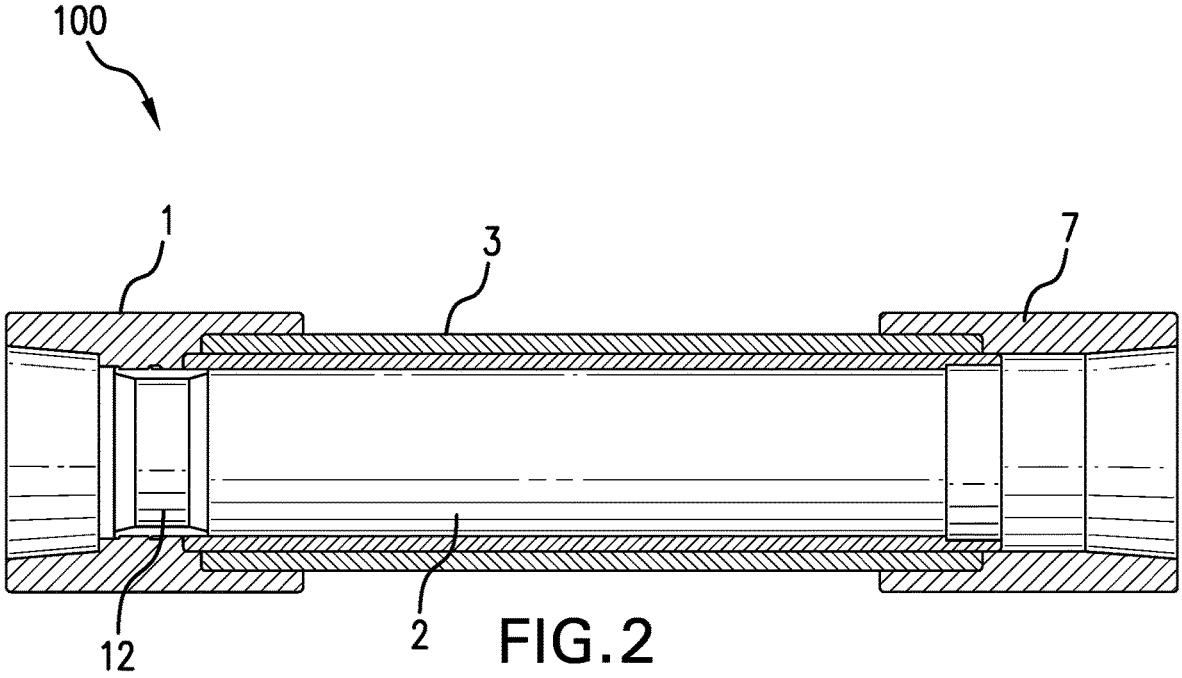
FIG. 2 is a cross-sectional view of the exemplary deposit control member of FIG. 1.

Disclosed are methods and systems for controlling deposit buildup using in-situ generated gas. Referring to FIGS. 1 and 2, a deposit control member 100 includes a gas generating element 2 and a cover 3 protecting the gas generating element 2. The gas generating element 2 can be directly coupled to cover 3. Alternatively, one end of the gas generating element 2 is mounted on spacer 12 coupled to cover 3. The deposit control member 100 can also include couplings 1 and 7 which connect the deposit control member 100 to other members of a flow assembly if needed. In an embodiment, the deposit control member 100 is disposed in a downhole environment in such a way that coupling 7 is facing uphole and coupling 1 is facing downhole. Such an arrangement allows an operator to easily retrieve and/or replace the gas generating element after the deposit control member is disposed downhole.

The gas generating element contains an active material which can react with a fluid contacting the gas generating element to generate a gas. In an embodiment, the active material is a metal alloy. Exemplary active materials comprise one or more of the following: a magnesium-based alloy; a zinc-based alloy; a lithium-based alloy; an aluminum-based alloy; a calcium-based alloy; a nickel-based alloy; a chromium-based alloy; or a vanadium-based alloy. As used herein, the term "metal-based alloy" means a metal alloy wherein the weight percentage of the specified metal in the alloy is greater than the weight percentage of any other component of the alloy, based on the total weight of the alloy. The metal alloy comprises one or more alloying elements that can react with the fluid contacting the gas generating element. In particular, the metal alloy comprises one or more alloying elements that react with water, an acid, or a combination thereof in the fluid that contacts the gas generating element, preferably in a downhole environment. Such alloying elements include but are not limited to magnesium, calcium, aluminum, zinc, lithium, sodium, potassium, or a combination comprising at least one of the foregoing.

The cover includes a material that is stable under downhole conditions. Exemplary materials for the cover includes copper, nickel, chromium, iron, titanium, alloys thereof, or a combination comprising at least one of the foregoing. In an embodiment, the material for the cover comprises steel, nickel-chromium based alloys such as INCONEL, and nickel-copper based alloys such as MONEL alloys.

Figure 3:
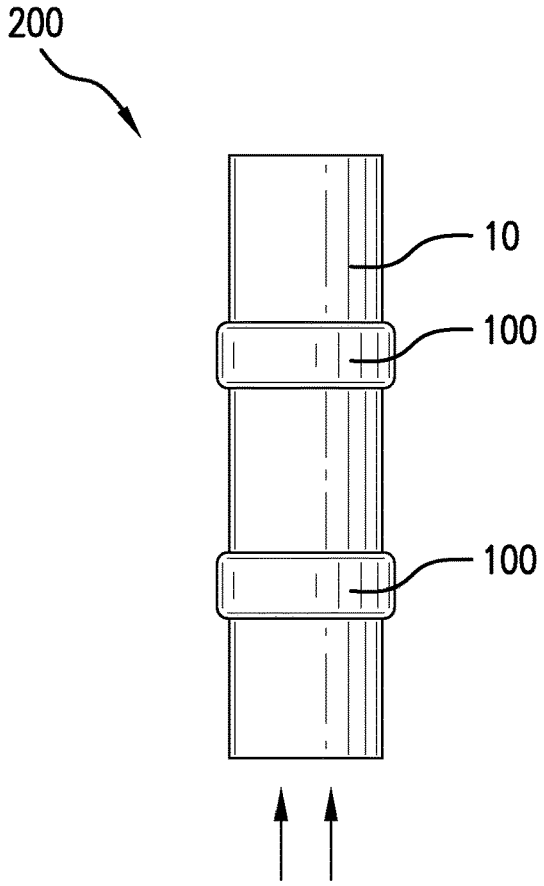
FIG. 3 illustrates an exemplary flow assembly comprising a deposit control member coupled to a tubular member.

The deposit control member 100 can be used in a flow assembly. As illustrated in FIG. 3, a flow assembly 200 includes a deposit control member 100 coupled to a tubular member 10. More than one deposit control member 100 can be used. The position of the deposit control member 100 is not particularly limited as long as it is disposed such that the fluid flows through the deposit control member 100 first before flowing through at least a portion of the tubular member 10. In such an arrangement, the in-situ generated gas can flow from the deposit control member to at least a portion of the tubular member, optionally together with the fluid, to impede the deposit from accumulating on the walls of the tubular member.

In an embodiment, the deposit control member 100 is mounted on an end of the tubular member 10. Alternatively or in addition, the deposit control member is disposed between two portions of the tubular member to couple them together. As shown in FIG. 3, the deposit control member can be in a tubular form.

Figure 4:
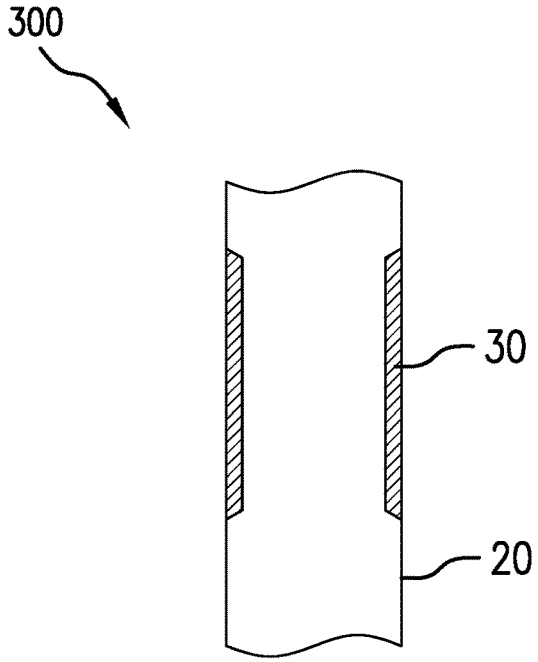
FIG. 4 illustrates a tubular member configured to control deposit buildup when exposed to a fluid comprising a gas generating element disposed inside a tubular member.

In some embodiments, the tubular member itself can have active materials that are effective to generate a gas in-situ when contacted with a fluid. In such embodiments, the deposit control member 100 is optional. FIG. 4 is a cross-sectional view of a flow assembly 300 configured to control deposit buildup when exposed to a fluid. The flow assembly 300 includes a tubular member 20 defining a fluid pathway; and a gas generating element 30 disposed inside the tubular member.

The fluid that reacts with the active material can be a downhole fluid. As used herein, a downhole fluid includes a fluid generated downhole such as a production fluid, a fluid introduced from the surface to a subterranean formation, or a combination thereof. The downhole fluid can include calcium ions, magnesium ions, barium ions, strontium ions, iron ions, manganese ions, zinc ions, aluminum ions, cerium ions, asphaltenes, wax, paraffin, hydrate, corrosion byproducts, or a combination comprising at least one of the foregoing. The downhole fluid can further contain water, an acid, or a combination thereof, which can react with the active material to generate a gas. The gas can be present in the form of bubbles. In an embodiment, the in-situ generated gas comprises hydrogen.

The deposit control member and the flow assembly as disclosed herein can have reduced deposits when used in a downhole environment. A method of using the tubular member and the flow assembly comprises exposing the tubular member and the flow assembly to a downhole fluid. To facilitate the formation of a gas in-situ, the tubular member and flow assembly can be disposed at a downhole location that has the pressure and temperature effective to facilitate a reaction between the active material and a downhole fluid.

The in-situ generated gas can control deposit buildup in a number of ways. For example the in-situ generated gas can remove the deposit by a localized pressure generated by the gas, reduce nucleation sites on a surface of the tubular member, facilitate the movement of the contaminant out of the flow assembly, or a combination comprising at least one of the foregoing. The method can be used to control the accumulation of inorganic and organic compounds such as $CaCO_3$, $BaSO_4$, $CaSO_4$, and $SrSO_4$, hydrates, asphaltenes, waxes, paraffins, corrosion byproducts, or a combination comprising at least one of the foregoing on the flow assembly.

Set forth are various embodiments of the disclosure.

Embodiment 1. A method of controlling deposit buildup, the method comprising: generating a gas by reacting an active material in a gas generating element with a fluid that contacts the gas generating element; and controlling deposit buildup with the generated gas.

Embodiment 2. The method of any of the preceding embodiments, wherein the generated gas is present in a form of bubbles in the fluid that contacts the gas generating element.

Embodiment 3. The method of any of the preceding embodiments, wherein the active material is a metal alloy.

Embodiment 4. The method of any of the preceding embodiments, wherein the active material comprises one or more of the following: a magnesium-based alloy; a zinc-based alloy; a lithium-based alloy; an aluminum-based alloy; a calcium-based alloy; a nickel-based alloy; a chromium-based alloy; or a vanadium-based alloy.

Embodiment 5. The method of any of the preceding embodiments, wherein the metal alloy comprises one or more alloying elements that reacts with water, an acid, or a combination thereof in the fluid that contacts the gas generating element.

Embodiment 6. The method of any of the preceding embodiments, wherein the fluid is a downhole fluid.

Embodiment 7. The method of any of the preceding embodiments, wherein the gas comprises hydrogen.

Embodiment 8. The method of any of the preceding embodiments, wherein the gas generating element is disposed inside a tubular member.

Embodiment 9. The method of any of the preceding embodiments, wherein the gas generating element is a part of a deposit control member.

Embodiment 10. The method of Embodiment 9, wherein the deposit control member is coupled to a tubular member, and the method further comprises allowing the gas to flow from the deposit control member to the tubular member.

Embodiment 11. The method of any of the preceding embodiments, further comprising disposing the gas generating element at a downhole location that has a pressure and temperature effective to facilitate a reaction between the active material and the fluid that contacts the gas generating element.

Embodiment 12. A deposit control member comprising: a gas generating element; and a cover to protect the gas generating element, the gas generating element containing an active material which is effective to react with a fluid that contacts the gas generating element to generate a gas.

Embodiment 13. The deposit control member of any of the preceding embodiments, wherein the gas generating element is mounted on a spacer coupled to the cover.

Embodiment 14. The deposit control member of any of the preceding embodiments, wherein the active material is a metal alloy comprising one or more of the following: a magnesium-based alloy; a zinc-based alloy; a lithium-based alloy; an aluminum-based alloy; a calcium-based alloy; a nickel-based alloy; a chromium-based alloy; or a vanadium-based alloy.

Embodiment 15. The deposit control member of Embodiment 14, wherein the metal alloy comprises one or more alloying elements that reacts with water, an acid, or a combination thereof in the fluid that contacts the gas generating element.

Embodiment 16. A flow assembly configured to control deposit buildup when exposed to a fluid, the flow control assembly comprising: a tubular member; and a deposit control member according to of any of the preceding embodiments coupled to the tubular member.

Embodiment 17. A flow assembly configured to control deposit buildup when exposed to a fluid, the flow control assembly comprising: a tubular member defining a fluid pathway; and a gas generating element disposed inside the tubular member, the gas generating element comprising an active a material effective to react with a fluid that contacts the gas generating element to generate a gas.

Embodiment 18. The flow assembly of any of the preceding embodiments, wherein the active material is a metal alloy comprising one or more alloying elements that reacts with water, an acid, or a combination thereof in the fluid that contacts the gas generating element.

All ranges disclosed herein are inclusive of the endpoints, and the endpoints are independently combinable with each other. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A method of controlling deposit buildup, the method comprising:

generating a gas by reacting an active material in a gas generating element with a downhole fluid that contacts the gas generating element to form a gas-containing fluid, the gas generating element being coupled to a tubular member having an inner surface defining a fluid pathway; and controlling deposit buildup on the inner surface of the tubular member with the generated gas by flowing the gas-containing fluid through the fluid pathway, wherein the active material is a metal alloy, and the deposit comprises $CaCO_3$, $BaSO_4$, $CaSO_4$, and $SrSO_4$, hydrates, asphaltenes, waxes, paraffins, corrosion byproducts, or a combination comprising at least one of the foregoing, wherein the metal alloy comprises a metal-based alloy, which comprises one or more of the following: a magnesium-based alloy; a zinc-based alloy; an aluminum-based alloy; a calcium-based alloy; a nickel-based alloy; a chromium-based alloy; or a vanadium-based alloy; and wherein the method further comprises disposing the gas generating element at a downhole location that has a pressure and temperature effective to facilitate a reaction between the active material and the downhole fluid that contacts the gas generating element.

2. The method of claim 1, wherein the generated gas is present in a form of bubbles in the downhole fluid that contacts the gas generating element.

3. The method of claim 1, wherein the metal alloy comprises one or more alloying elements that reacts with water, an acid, or a combination thereof in the downhole fluid that contacts the gas generating element.

4. The method of claim 1, wherein the gas comprises hydrogen.

5. The method of claim 1, wherein the gas generating element is disposed inside the tubular member.

6. The method of claim 1, wherein the gas generating element is a part of a deposit control member.

7. The method of claim 6, wherein the deposit control member is coupled to the tubular member, and the method further comprises allowing the gas to flow from the deposit control member to the tubular member.

8. The method of claim 1, further comprising removing a deposit on the surface of the tubular member by a localized pressured generated by the gas.

9. The method of claim 1, wherein the deposit control member is in a tubular form.

10. The method of claim 1, wherein the gas generating element is disposed inside the tubular member.

11. The method of claim 1, wherein the deposit control member is mounted on an end of the tubular member.

12. The method of claim 1, wherein the deposit control member is disposed between two portions of the tubular member to couple them together.

13. The method of claim 1, wherein the deposit control member has a cover that protects the gas generating element.

14. The method of claim 13, wherein the cover comprises copper, nickel, chromium, iron, titanium, alloys thereof, or a combination comprising at least one of the foregoing.

15. The method of claim 13, wherein the gas generating element is coupled to the cover via a spacer disposed between the gas generating element and the cover.

16. The method of claim 1, further comprising disposing the gas generating element and the tubular member in a downhole environment, and the gas-containing fluid is formed in the downhole environment.

* * * * *